US007509705B1

(12) United States Patent
Morad et al.

(10) Patent No.: US 7,509,705 B1
(45) Date of Patent: Mar. 31, 2009

(54) DUSTPAN HAVING INTERLOCKABLE MATING GROOVES AND CHANNELS TO FACILITATE STACKING TOGETHER AT LEAST TWO DUSTPANS

(75) Inventors: Fred I. Morad, Toluca Lake, CA (US); William Camp, Vanlue, OH (US)

(73) Assignee: Worldwide Integrated Resources, Inc., Montebello, CA (US)

( * ) Notice: Subject to any disclaimer, the term of this patent is extended or adjusted under 35 U.S.C. 154(b) by 774 days.

(21) Appl. No.: 11/136,011

(22) Filed: May 23, 2005

(51) Int. Cl.
*A47L 13/52* (2006.01)

(52) U.S. Cl. ..... 15/257.1; 15/257.7

(58) Field of Classification Search ..... 15/257.1, 15/257.7

See application file for complete search history.

(56) References Cited

U.S. PATENT DOCUMENTS

| | | | | |
|---|---|---|---|---|
| 2,277,383 | A * | 3/1942 | Bowers | 15/257.5 |
| 2,651,924 | A * | 9/1953 | Lawrence | 15/257.1 |
| 4,509,226 | A * | 4/1985 | Allison et al. | 15/257.06 |
| 4,815,604 | A * | 3/1989 | O'Neil et al. | 206/518 |
| 6,679,948 | B2 * | 1/2004 | Mead | 134/6 |

* cited by examiner

*Primary Examiner*—Randall Chin
(74) *Attorney, Agent, or Firm*—Thomas I. Rozsa

(57) ABSTRACT

An improved dustpan having interlockable mating grooves and channels to facilitate stacking together at least two dustpans. The unique feature of the present invention is to form at least one groove in the sidewall of a dustpan, which groove has an interior chamber and an exteriorly projecting bulge so that when slid together, the exterior bulge of the upper dustpan slides into the chamber of the groove of the lower dustpan so that they are locked together. In a preferred embodiment, the upper interior wall of the interior chamber and the upper portion of the bulge start at the same downward angle from front to back to facilitate locking two dustpans together.

22 Claims, 4 Drawing Sheets

DUSTPAN HAVING INTERLOCKABLE MATING GROOVES AND CHANNELS TO FACILITATE STACKING TOGETHER AT LEAST TWO DUSTPANS

BACKGROUND OF THE INVENTION

1. Field of the Invention

The present invention generally relates to the field of cleaning implements and more particularly, to dustpans into which dirt and debris are swept.

2. Description of the Prior Art

In general, dustpans have been in existence for many years. Most conventional dustpans have smooth sidewalls and smooth bottom surfaces. While the smooth surface provides effective receptacles for receiving dirt and debris, it is virtually impossible to lock adjoining dustpans so they can be locked together for carrying purposes and display purposes. The smooth lower surface and smooth sidewalls prohibit this interlocking and stacking ability. There is a significant need for an improved dustpan which provides these new and desirable features.

SUMMARY OF THE INVENTION

The present invention is an improved dustpan having interlockable mating grooves and channels to facilitate stacking together at least two dustpans. The unique feature of the present invention is to form at least one groove in the sidewall of a dustpan, which groove has an interior chamber and an exteriorly projecting bulge so that when slid together, the exterior bulge of the upper dustpan slides into the chamber of the groove of the lower dustpan so that they are locked together. In a preferred embodiment, the upper interior wall of the interior chamber and the upper portion of the bulge start at the same downward angle from front to back to facilitate locking two dustpans together.

It is also within the spirit and scope of the present invention to have the lower interior wall of the interior chamber of the lower portion of the bulge start at the same downward angle from front to back.

It has been discovered, according to the present invention, that if at least one sidewall of a dustpan has formed into it an elongated groove having an interior chamber and having an exterior outwardly extending bulge whereby both the upper wall of the interior chamber and upper portion of the bulge have the same downwardly extending angle from front to back, then two dustpans can be locked together to cause the exterior bulge of the upper dustpan to be slid into the interior chamber of the groove of the lower dustpan.

It has further been discovered, according to the present invention, that if the dustpan further have formed into its lower surface at least one channel having a depth extending into the lower surface and a bulge of a height extending below the lower surface, aligned channels in an upper or lower dustpan can further secure the locking arrangement.

It has additionally been discovered, according to the present invention, that a pair of oppositely disposed elongated grooves on opposite sidewalls will better enable the two dustpans to be locked together.

It has also been discovered, according to the present invention, that a pair of parallel spaced apart channels formed into the lower surface would provide a more secure additional locking feature.

It is therefore an object of the present invention to form locking grooves and channels into a dustpan to enable at least two adjacent dustpans to be locked together so that they can be carried together and placed on display together.

It is additionally an object of the present invention to provide a means to lock a multiplicity of dustpans together to enable a multiplicity of dustpans to be locked together.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
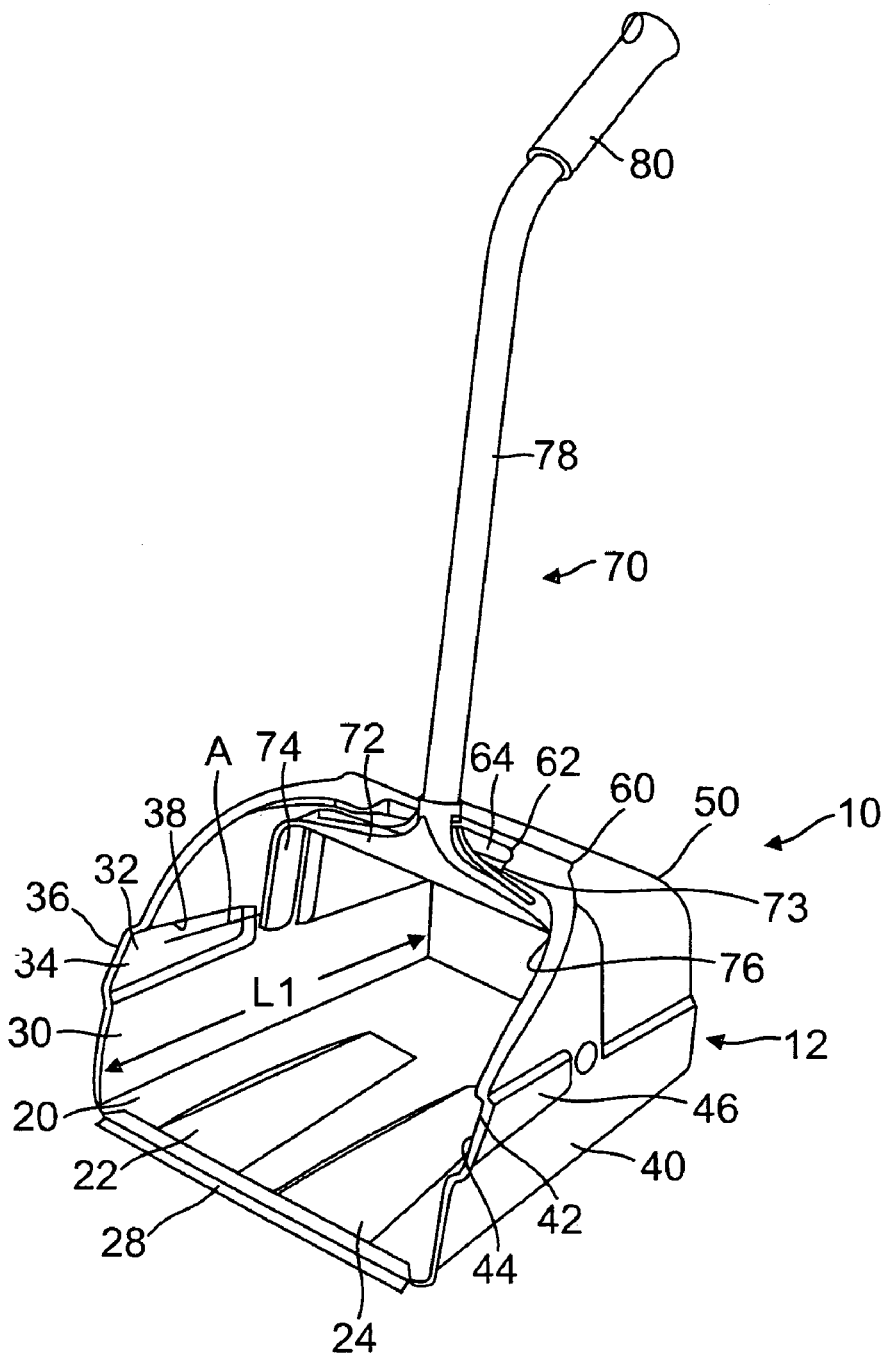
FIG. 1 is a perspective view of the present invention dustpan having interlockable means.
Figure 4:
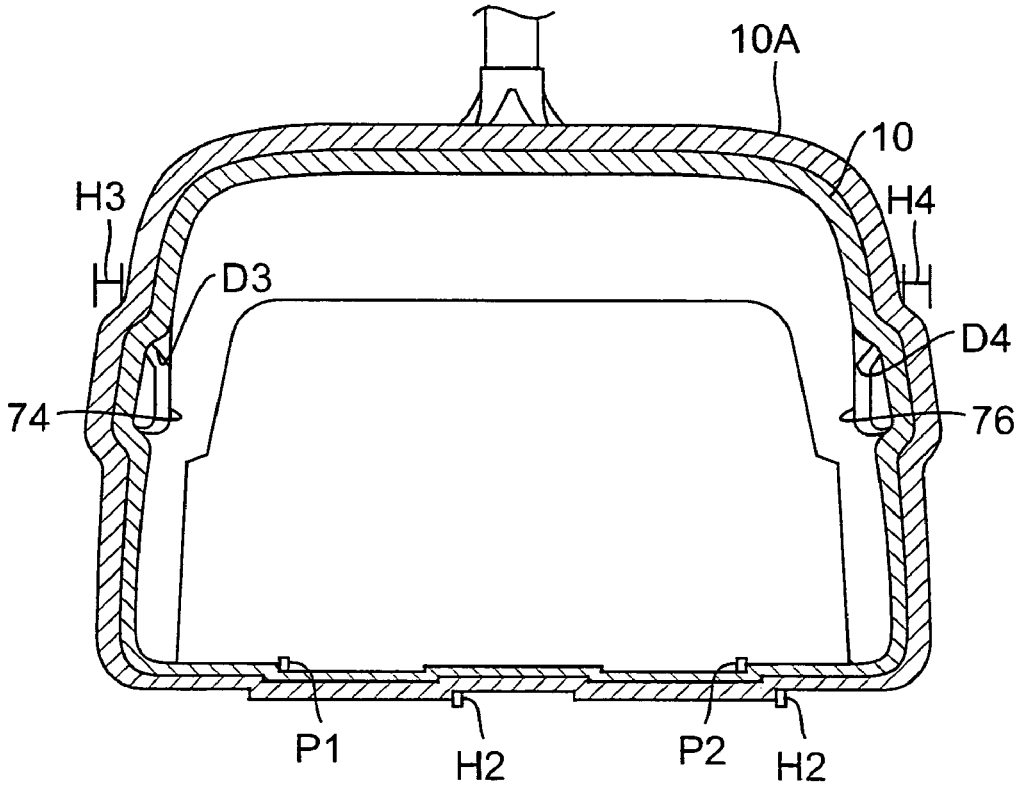
FIG. 4 is a cross-sectional view of a portion of two interlocked dustpans of the present invention, showing how they are locked together.

One present invention dustpan 10 is illustrated in FIG. 1. The dustpan 10 has a body 12 comprising a lower surface 20, a first sidewall 30, a parallel oppositely disposed second sidewall 40, a rear wall 50 which joins the lower surface 20 and first and second sidewalls 30 and 40, and an upper surface 60. Lower surface 20 has a first elongated channel 22 which extends from adjacent front lip 28 at the front of the lower surface 20 toward the rear wall 50, and can extend from approximately one-half to three-quarters of the length L1 of lower surface 20. First elongated channel 22 also decreases in depth from the front lip 28 as it extends along the length of lower surface 20. The depth adjacent the front lip 28 D1 is illustrated in FIG. 4. While the present invention will work with at least one elongated channel 22, in the preferred embodiment there is a second elongated channel 24 which is spaced apart from and parallel to first elongated channel 22. Second elongated channel 24 also extends from adjacent front lip 28 at the front of the lower surface 20 toward the rear wall 50, and can extend from approximately one-half to three-quarters of the length L1 of lower surface 20. Second elongated channel 24 also decreases in depth from the front lip 28 as it extends along the length of lower surface 20. The depth adjacent front lip 28 D2 (see FIG. 4) is the same as depth D1. In addition to extending into the lower surface, 20 the channels 22 and 24 extend below the lower surface by a height H1 and H2 respectively adjacent front lip 28, as illustrated in FIG. 4. The height also decreases from the front lip 28 and it extends along the length of the lower surface. In addition, the interior width W1 of the channel adjacent the front lip 28 is approximately twice as wide as the width W2 at the rearmost part of the channel. In this way, when two adjacent dustpans 10 are slid together, the bottom of channels 24 and 26 of the upper dustpan slide into the top of the respectively aligned channels 24 and 26 of the lower dustpan, as illustrated in FIG. 4.

First sidewall 30 has a first elongated groove 32 which extends from the front of the sidewall along the length L1 of first sidewall 30 for a distance of approximately one-third of the length L1. The groove 32 has an interior chamber 34 which extends into first sidewall 30 and an exterior bulge 36 which protrudes laterally and outwardly from first sidewall 30. The upper wall 38 of the interior grooves is slanted at a downward angle "A" to facilitate locking. While the present invention will work with at least one elongated groove 32, in the preferred embodiment, there is a second elongated groove 42 which is formed into second sidewall 40, which also extends from the front of the sidewall along the length L1 of second sidewall 40 for a distance of approximately one-third of the length L1. The groove 42 has an interior chamber 44 which extends into second sidewall 40 with a slanted upper wall that has a downward slant at an angle "A", and an exterior bulge 46 which protrudes laterally and outwardly from second sidewall 40. In the preferred embodiment, first groove 32 and second groove 42 are parallel to each other. The upper wall of each exterior bulge also extends downwardly by the same angle "A". Referring to FIG. 4, first groove 32 has a depth D3 extending into first sidewall 30 and has a bulge H3 extending outwardly from first sidewall 30. Similarly, second groove 42 has a depth D4 extending into second sidewall 40 and has a bulge H4 extending outwardly from second sidewall 40. The depths D3 and D4 remain approximately the same as the grooves 32 and 42 extend into the dustpan body 12. Similarly, the lengths H3 and H4 remain approximately the same as the grooves 32 and 34 extend into the dustpan body 10. However, the vertical height of the interior chamber of the groove decreases from the front to the rear of the groove. Vertical height H5 at the location adjacent the front of the dustpan is approximately one and one-half the height H6 at the location of the rear of the groove. Similarly, the vertical height of the exterior bulge decreases by the same amount from the front to the rear of the grooves. In this way, when two adjacent dustpans 10 are slid together, the exterior bulges 36 and 46 of the upper dustpan respectively slide into the respectively aligned interior chambers 34 and 44 of the lower dustpan, as illustrated in FIG. 4. While it is preferred for the upper walls to slant downwardly at an angle "A", it is also possible for the lower walls of the interior channels and bulges to slant downwardly by the angle "A".

Figure 2:
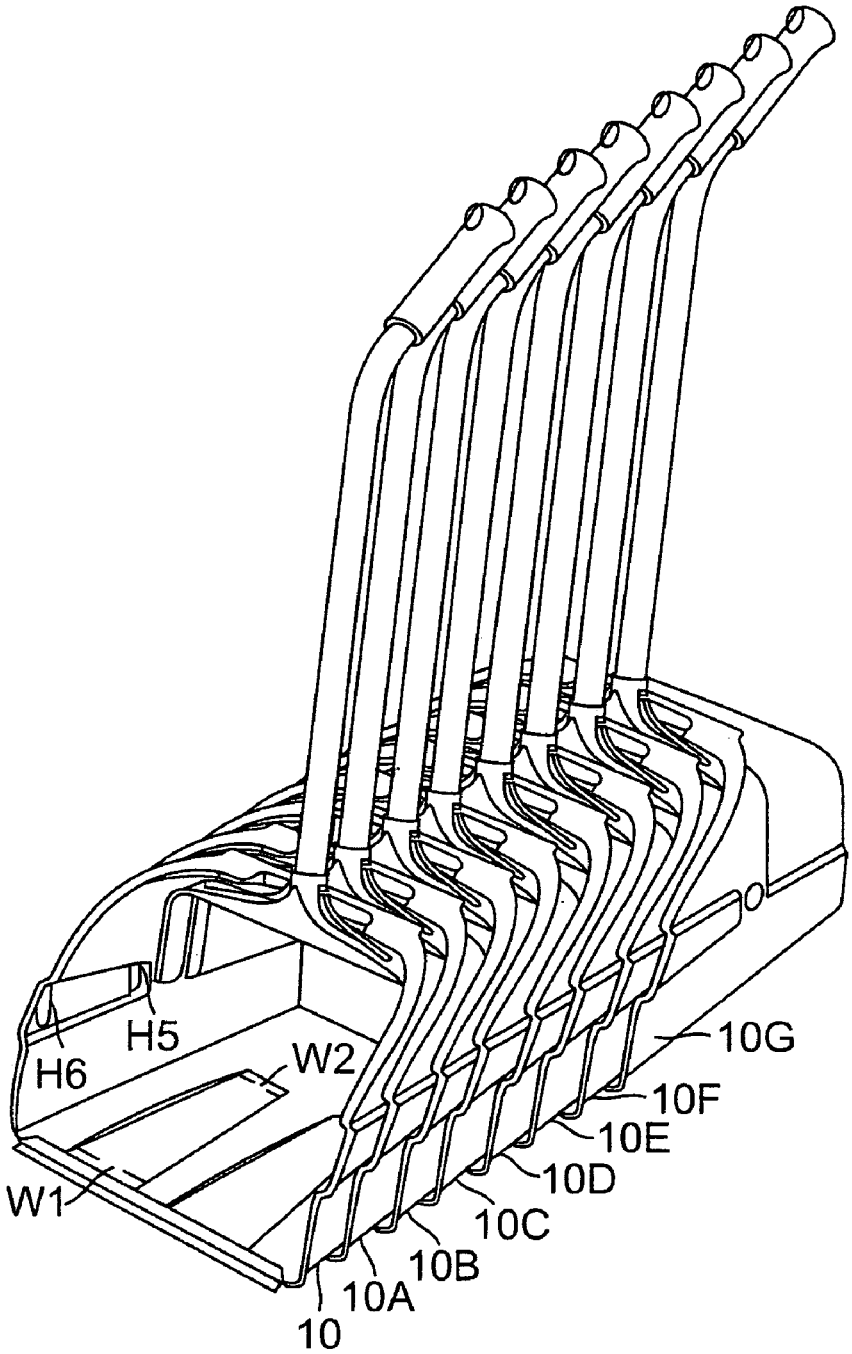
FIG. 2 is an perspective view of a multiplicity of the present invention dustpans being locked together through their respective interlockable means.
Figure 3:
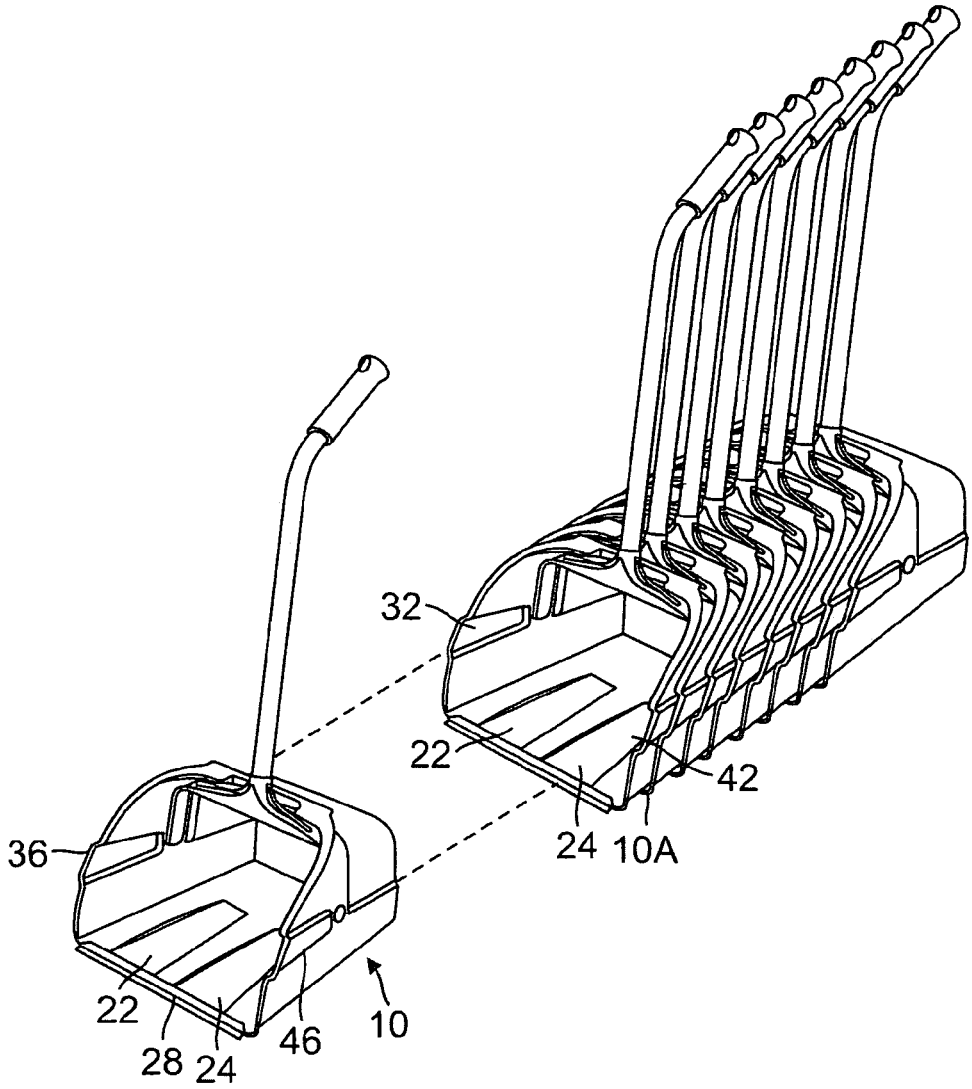
FIG. 3 is a partially exploded view of a multiplicity of the present invention dustpans being locked together through their respective interlockable means with the first dustpan removed to illustrate how the dustpans are locked together.

By having two sets of interlocking channels 22 and 24 and two sets of interlocking grooves 32 and 42, a top of first dustpan 10 can be retained into the next adjacent or lower dustpan 10 and the two dustpans can be locked together for carrying and displaying purposes. The process by which a first dustpan 10 is slid into the next adjacent dustpan 10A is illustrated in FIG. 3. In fact, the interlocking feature is so strong that any multiplicity of dustpans can be locked together, such as eight dustpans 10, 10A, 10B, 10C, 10D, 10E, 10F and 10G, as illustrated in FIG. 2.

Two sets of interlocking features can accommodate any desired handle by which an individual dustpan is carried. One such handle 70 is illustrated in FIG. 1. The handle 70 includes a horizontal bar 72 having a first transverse member 74 which is rotatably connected to first sidewall 30, a second transverse member 76 which is rotatably connected to second sidewall 40, an elongated shaft 78 attached at one end to the horizontal bar 72 with a gripping portion 80 at the opposite end of shaft 78. The front portion 62 of top 60 has an interior locking channel 64 which receives a transverse locking lip 73 located at the back of horizontal bar 72 so that the handle 70 can be locked into the top 60 to facilitate carrying a dustpan 10 and to facilitate holding the dustpan steady as dirt and debris are swept into the dustpan. The rotatable feature of the handle enables the handle to be tilted forward for various cleaning uses. In one option, the shaft 78 is also rotatably connected to horizontal bar 72 so that the handle 70 can be rotated to any orientation relative to the horizontal bar 72.

The dustpan body including the lower surface 20 and its channels 22 and 24, the sidewalls 30 and 40 and their respective grooves 32 and 42, the rear wall 50, the top 60 and its interlocking channel 64, can all be molded in a single molding operation to efficiently produce the body 12. The dustpan body can be formed of any suitable material such as plastic, rubber, polypropylene, etc. It is also within the spirit and scope of the present invention to have the dustpan body formed out of rubber, or any synthetic material.

Defined in detail, the present invention is a dustpan comprising: (a) a body having a front, a lower surface having a front lip at its front, a first sidewall, a parallel oppositely disposed second sidewall, a rear wall and an upper member; (b) the lower surface having a first elongated channel extending from adjacent the front lip toward the rear wall, the first elongated channel extending for a given depth into the lower surface and extending for a given height below the lower surface, and a second elongated channel extending from adjacent the front lip toward the rear wall, the second elongated channel extending for a given depth into the lower surface and extending for a given height below the lower surface, the first and second elongated channels being spaced apart and parallel to each other; (c) the first sidewall having a first elongated groove which extends from the front of the sidewall toward the rear wall, and having an upper wall which slants at a downward angle from front to back, the first elongated groove having an interior chamber having a given depth and a bulge which extends laterally and outwardly from the first sidewall by a given height, the vertical height of the interior chamber decreasing from a location adjacent the front to the rear of the interior chamber, the vertical height of the exterior bulge also decreases from the front to the rear by the same amount and extending at the same downward angle as the upper wall of the interior chamber; (d) the second sidewall having a second elongated groove which extends from the front of the sidewall toward the rear wall and having an upper wall which slants at a downward angle from front to back, the second elongated groove having an interior chamber having a given depth and a bulge which extends laterally and outwardly from the second sidewall by a given height, the vertical height of the interior chamber decreasing from a location adjacent the front to the rear of the interior chamber, the vertical height of the exterior bulge also decreasing from the front to the rear by the same amount and slanting at the same downward angle as the upper wall of the interior chamber; and (e) means for holding and carrying the dustpan; (f) whereby, when two dustpans are slid together so that one is above the other, the first and second elongated channels of the upper dustpan interlock with the respectively aligned first and second channels of the lower dustpan by having the portion of the elongated channel below the lower surface of the upper dustpan interlocking with the portion of the elongated channel above the upper surface of the lower dustpan, and the first and second grooves of the upper dustpan interlock with the respectively aligned first and second grooves of the lower dustpan where the bulge of each elongated groove of the upper dustpan interlocks with the respective interior chamber of the elongated grooves of the lower dustpan.

Defined broadly, the present invention is a dustpan comprising: (a) a body having a front, a lower surface, a first sidewall, a parallel oppositely disposed second sidewall, a rear wall and an upper member; (b) the lower surface having at least one elongated channel extending for a given depth into the lower surface and extending for a given height below the lower surface; (c) at least one elongated groove formed into either the first sidewall or the second sidewall and extending from the front, the at least one elongated groove having an interior chamber having a given depth and an upper wall which extends at a downward angle from front to back, and a bulge which extends laterally and outwardly from the sidewall into which the groove is formed by a given height, the vertical height of the interior chamber decreasing from a location adjacent the front to the rear of the chamber, the vertical height of the bulge also decreasing from the front to the rear by the same amount with the upper portion extending at the same downward angle as the upper wall of the chamber; and (d) means for holding and carrying the dustpan; (e) whereby when two dustpans are slid together so that their respective at least one elongated channel and at least one elongated grooves are aligned, the portion of the elongated channel below the lower surface of the upper dustpan interlocks with the portion of the elongated channel above the upper surface of the lower dustpan and the bulge of the elongated groove of the upper dustpan interlocks with the interior chamber of the elongated groove of the lower dustpan.

Defined more broadly, the present invention is a dustpan comprising: (a) a body having a front, a lower surface, a first sidewall, a parallel oppositely disposed second sidewall, a rear wall and an upper member; (b) the lower surface having at least one elongated channel extending for a given depth into the lower surface and extending for a given height below the lower surface; (c) at least one elongated groove formed into either the first sidewall or the second sidewall and extending from the front, the at least one elongated groove having an interior chamber having a given depth, and a bulge which extends laterally and outwardly from the sidewall into which the groove is formed by a given height; and (d) means for holding and carrying the dustpan; (e) whereby when two dustpans are slid together so that their respective at least one elongated channel and at least one elongated grooves are aligned, the portion of the elongated channel below the lower surface of the upper dustpan interlocks with the portion of the elongated channel above the upper surface of the lower dustpan and the bulge of the elongated groove of the upper dustpan interlocks with the interior chamber of the elongated groove of the lower dustpan.

Defined even more broadly, the present invention is a dustpan comprising: (a) a body having a front, a lower surface, a first sidewall, a parallel oppositely disposed second sidewall, a rear wall and an upper member; (b) at least one elongated groove formed into either the first sidewall or the second sidewall and extending from the front, the at least one elongated groove having an interior chamber having a given depth and an upper wall which extends at a downward angle from front to back, and a bulge which extends laterally and outwardly from the sidewall into which the groove is formed by a given height, the vertical height of the interior chamber decreasing from a location adjacent the front to the rear of the chamber, the vertical height of the bulge also decreasing from the front to the rear by the same amount with the upper portion extending at the same downward angle as the upper wall of the chamber; and (c) means for holding and carrying the dustpan; (d) whereby when two dustpans are slid together so that their respective at least one elongated channel and at least one elongated grooves are aligned, the portion of the elongated channel below the lower surface of the upper dustpan interlocks with the portion of the elongated channel above the upper surface of the lower dustpan and the bulge of the elongated groove of the upper dustpan interlocks with the interior chamber of the elongated groove of the lower dustpan.

Defined even more broadly, the present invention is a dustpan comprising: (a) a body having a front and at least one sidewall; and (b) at least one elongated groove formed into the at least one sidewall and extending from the front, the at least one elongated groove having an interior chamber having a given depth with a bulge which extends laterally and outwardly from the sidewall into which the groove is formed by a given height; (c) whereby when two dustpans are slid together so that their respective at least one elongated grooves are aligned, the bulge of the elongated groove of the upper dustpan interlock with the interior chamber of the elongated groove of the lower dustpan.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A dustpan comprising:

a. a body having a front, a lower surface having a front lip at its front, a first sidewall, a parallel oppositely disposed second sidewall, a back having a rear wall and an upper member;

b. said lower surface having a first elongated channel extending from adjacent the front lip toward the rear wall, the first elongated channel extending for a given depth into the lower surface and extending for a given height below the lower surface, and a second elongated channel extending from adjacent the front lip toward the rear wall, the second elongated channel extending for a given depth into the lower surface and extending for a given height below the lower surface, the first and second elongated channels being spaced apart and parallel to each other;

c. said first sidewall having a first elongated groove which extends from the front of the sidewall toward the rear wall, and having an upper wall which slants at a downward angle from front to back, the first elongated groove having an interior chamber having a given depth and a bulge which extends laterally and outwardly from the first sidewall by a given height, the vertical height of the interior chamber decreasing from a location adjacent the front to the rear of the interior chamber, the vertical height of the exterior bulge also decreases from the front to the rear by the same amount and extending at the same downward angle as the upper wall of the interior chamber;

d. said second sidewall having a second elongated groove which extends from the front of the sidewall toward the rear wall and having an upper wall which slants at a downward angle from front to back, the second elongated groove having an interior chamber having a given depth and a bulge which extends laterally and outwardly from the second sidewall by a given height, the vertical height of the interior chamber decreasing from a location adjacent the front to the rear of the interior chamber, the vertical height of the exterior bulge also decreasing from the front to the rear by the same amount and slanting at the same downward angle as the upper wall of the interior chamber; and e. means for holding and carrying the dustpan;

f. whereby, when two dustpans are slid together so that one is above the other, the first and second elongated channels of the upper dustpan interlock with the respectively aligned first and second channels of the lower dustpan by having the portion of the elongated channel below the lower surface of the upper dustpan interlocking with the portion of the elongated channel above the upper surface of the lower dustpan, and the first and second grooves of the upper dustpan interlock with the respectively aligned first and second grooves of the lower dustpan where the bulge of each elongated groove of the upper dustpan interlocks with the respective interior chamber of the elongated grooves of the lower dustpan.

2. A dustpan in accordance with claim 1, wherein the vertical height of the interior chamber of each groove at the location adjacent the front of the dustpan is approximately one and a half times the height at the location of the most interior portion of the chamber and the corresponding height of each exterior bulge at the location adjacent the front of the dustpan is approximately one and a half times the height at the inward most location of each respective bulge.

3. A dustpan in accordance with claim 1, wherein the width of each channel at the location adjacent the front of the dustpan is approximately twice the width of the channel at its inward most location.

4. A dustpan in accordance with claim 1, wherein the depth of each elongated channel decreases from the front of the channel toward the rearmost portion of each channel.

5. A dustpan in accordance with claim 1, wherein said means to hold and carry the dustpan further comprises a horizontal bar connected to a first and second transverse member at either end with the first and second transverse members respectively rotatably connected to the first and second sidewalls, a shaft connected to said transverse bar at one end with a gripping portion at the other end of the shaft.

6. A dustpan in accordance with claim 5, further comprising means to lock the transverse bar to the upper member.

7. A dustpan in accordance with claim 5, further comprising means to lock the transverse bar to the upper member.

8. A dustpan in accordance with claim 5, wherein the body of the dustpan is molded from a single piece of material selected from the group comprising plastic, rubber and polypropylene.

9. A dustpan in accordance with claim 1, wherein the body of the dustpan is molded from a single piece of material selected from the group comprising plastic, rubber and polypropylene.

10. A dustpan comprising:

a. a body having a front, a lower surface, a first sidewall, a parallel oppositely disposed second sidewall, a back having a rear wall and an upper member;

b. said lower surface having at least one elongated channel extending for a given depth into the lower surface and extending for a given height below the lower surface;

c. at least one elongated groove formed into either the first sidewall or the second sidewall and extending from the front, the at least one elongated groove having an interior chamber having a given depth and an upper wall which extends at a downward angle from front to back, and a bulge which extends laterally and outwardly from the sidewall into which the groove is formed by a given height, the vertical height of the interior chamber decreasing from a location adjacent the front to the rear of the chamber, the vertical height of the bulge also decreasing from the front to the rear by the same amount with the upper portion extending at the same downward angle as the upper wall of the chamber; and d. means for holding and carrying the dustpan;

e. whereby when two dustpans are slid together so that their respective at least one elongated channel and at least one elongated grooves are aligned, the portion of the elongated channel below the lower surface of the upper dustpan interlocks with the portion of the elongated channel above the upper surface of the lower dustpan and the bulge of the elongated groove of the upper dustpan interlocks with the interior chamber of the elongated groove of the lower dustpan.

11. A dustpan in accordance with claim 10, wherein the vertical height of the interior chamber of the at least one groove at the location adjacent the front of the dustpan is approximately one and a half times the height at the location of the most interior portion of the chamber and the corresponding height of the exterior bulge at the location adjacent the front of the dustpan is approximately one and a half times the height at the inward most location of the bulge.

12. A dustpan in accordance with claim 11, wherein the width of the at least one channel a the location adjacent the front of the dustpan is approximately twice the width of the channel at its inward most location.

13. A dustpan in accordance with claim 11, wherein the depth of each elongated channel decreases from the front of the channel toward the rearmost portion of each channel.

14. A dustpan in accordance with claim 11, wherein said means to hold and carry the dustpan further comprises a horizontal bar connected to a first and second transverse member at either end with the first and second transverse members respectively rotatably connected to the first and second sidewall, a shaft connected to said transverse bar at one end with a gripping portion at the other end of the shaft.

15. A dustpan comprising:

a. a body having a front, a lower surface, a first sidewall, a parallel oppositely disposed second sidewall, a rear wall and an upper member;

b. said lower surface having at least one elongated channel extending for a given depth into the lower surface and extending for a given height below the lower surface;

c. at least one elongated groove formed into either the first sidewall or the second sidewall and extending from the front, the at least one elongated groove having an interior chamber having a given depth, and a bulge which extends laterally and outwardly from the sidewall into which the groove is formed by a given height; and d. means for holding and carrying the dustpan;

e. whereby when two dustpans are slid together so that their respective at least one elongated channel and at least one elongated grooves are aligned, the portion of the elongated channel below the lower surface of the upper dustpan interlocks with the portion of the elongated channel above the upper surface of the lower dustpan and the bulge of the elongated groove of the upper dustpan interlocks with the interior chamber of the elongated groove of the lower dustpan.

16. A dustpan in accordance with claim 15, wherein said means to hold and carry the dustpan further comprises a horizontal bar connected to a first and second transverse member at either end with the first and second transverse members respectively rotatably connected to the first and second sidewall, a shaft connected to said transverse bar at one end with a gripping portion at the other end of the shaft.

17. A dustpan comprising:

a. a body having a front, a lower surface, a first sidewall, a parallel oppositely disposed second sidewall, a back having a rear wall and an upper member;

b. at least one elongated groove formed into either the first sidewall or the second sidewall and extending from the front, the at least one elongated groove having an interior chamber having a given depth and an upper wall which extends at a downward angle from front to back, and a bulge which extends laterally and outwardly from the sidewall into which the groove is formed by a given height, the vertical height of the interior chamber decreasing from a location adjacent the front to the rear of the chamber, the vertical height of the bulge also decreasing from the front to the rear by the same amount with the upper portion extending at the same downward angle as the upper wall of the chamber; and c. means for holding and carrying the dustpan;

d. whereby when two dustpans are slid together so that their respective at least one elongated channel and at least one elongated grooves are aligned, the portion of the elongated channel below the lower surface of the upper dustpan interlocks with the portion of the elongated channel above the upper surface of the lower dustpan and the bulge of the elongated groove of the upper dustpan interlocks with the interior chamber of the elongated groove of the lower dustpan.

18. A dustpan in accordance with claim 17, wherein the vertical height of the interior chamber of the at least one groove at the location adjacent the front of the dustpan is approximately one and a half times the height at the location of the most interior portion of the chamber and the corresponding height of the exterior bulge at the location adjacent the front of the dustpan is approximately one and a half times the height at the inward most location of the bulge.

19. A configuration for interlocking two objects comprising:

a. each object having a body of a dustpan, each body having a front and at least one sidewall; and b. for each body at least one elongated groove formed into the at least one sidewall and extending from the front, the at least one elongated groove having an interior chamber having a given depth with a bulge which extends laterally and outwardly from the sidewall into which the groove is formed by a given height;

c. whereby when two dustpans are slid together so that their respective at least one elongated grooves are aligned, the bulge of the elongated groove of the upper dustpan interlocks with the interior chamber of the elongated groove of the lower dustpan, wherein for each dustpan the vertical height of the interior chamber of the at least one groove at the location adjacent the front of the dustpan is approximately one and one-half times the height at the location of the most interior portion of the chamber and the corresponding height of the exterior bulge at the location adjacent the front of the dustpan is approximately one and a half times the height at the inward most location of the bulge.

20. Two objects in accordance with claim 19, wherein for each dustpan the vertical height of the interior chamber decreases from a location adjacent the front to the rear of the chamber and the vertical height of the bulge also decreases from the front to the rear by the same amount.

21. Two objects in accordance with claim 19, further comprising for each dustpan means for holding and carrying the dustpan.

22. Two objects in accordance with claim 19, wherein for each dustpan the body and the at least one elongated groove are formed from a single piece of material selected from the group comprising plastic, rubber and polypropylene.

* * * * *